US006055395A

United States Patent [19]

Hiramoto

[11] Patent Number: 6,055,395

[45] Date of Patent: Apr. 25, 2000

[54] TRANSFER APPARATUS

[75] Inventor: Yoshiaki Hiramoto, Yamatokoriyama, Japan

[73] Assignee: Sharp Kabushiki Kaisha, Osaka, Japan

[21] Appl. No.: 09/056,091

[22] Filed: Apr. 7, 1998

[30] Foreign Application Priority Data

Apr. 8, 1997 [JP] Japan ..... P9-089023

[51] Int. Cl.[7] ..... G03G 15/16

[52] U.S. Cl. ..... 399/121; 399/311; 399/316

[58] Field of Search ..... 399/121, 297, 399/311, 316, 317, 312, 314, 315; 361/220, 225; 250/324, 325, 326

[56] References Cited

U.S. PATENT DOCUMENTS

| | | | |
|---|---|---|---|
| 4,260,240 | 4/1981 | Pieper | 399/121 |
| 4,806,967 | 2/1989 | Newbury | 399/311 |
| 5,111,246 | 5/1992 | Brailsford et al. | 399/98 |
| 5,138,396 | 8/1992 | Satou et al. | 399/316 |
| 5,144,383 | 9/1992 | Murano et al. | 399/316 |
| 5,546,171 | 8/1996 | Hayashi et al. | 399/297 |
| 5,552,873 | 9/1996 | Hirao et al. | 399/315 |
| 5,758,247 | 5/1998 | Yanashima et al. | 399/384 |
| 5,774,324 | 6/1998 | Hayashi et al. | 399/171 |
| 5,923,935 | 7/1999 | Yamaguchi | 399/297 |

*Primary Examiner*—Arthur T. Grimley
*Assistant Examiner*—William A. Noe

[57] ABSTRACT

Shield members **9*b*-1 and 9*b*-2 constituting a transfer unit 9 for a transfer apparatus are inserted from the bottom of a transfer holder 40 fabricated by integrating a pre-transfer guide 31 and a post-transfer guide 34 together with wire fixing portions 41*a* and 41*b* for fixing a corona discharge wire 9*a* into one. Thereafter the shield members 9*b*-1, 9*b*-2 are positioned with respect to the transfer holder 40, and the assembly of the transfer apparatus is completed. The transfer apparatus is thus easily assembled, and the pre/post-transfer guides 31 and 34 can be positioned more accurately with respect to the transfer unit 9** and the corona discharge wire.

14 Claims, 8 Drawing Sheets

TRANSFER APPARATUS

BACKGROUND OF THE INVENTION

1. Field of the Invention

The present invention relates to a transfer apparatus which is used for image forming apparatuses or the like, specifically, to a transfer apparatus for transferring in good conditions an image formed on a recording medium onto a conveyed sheet or the like for transfer.

2. Description of the Related Art

In an image forming apparatus, for example, an electrophotographic image forming apparatus, a toner image is formed on a photosensitive member as a recording medium and transferred onto a transfer sheet such as ordinary paper. Then, in order to retain the toner image transferred onto the sheet as a permanent image, the image transferred sheet is passed through, for example, a heat fixing device to fix the transferred image, and then discharged out of the main body of the apparatus.

In such a image forming apparatus, in order to form a desired image on a sheet, it is necessary to feed the sheet to an image forming position, specifically, to a transfer position. For instance, a lot of sheets are held in a paper feeding cassette and sent one by one from the cassette to a conveying path which leads to an image forming portion, specifically, to a transfer position where the toner image formed on the photosensitive member is transferred.

For example, Japanese Unexamined Utility Model Publication JP-U-4-101567 (1992) discloses, as shown in FIG. 10, a photosensitive drum 50 of a recording medium is exposed to an optical image corresponding to record information to form an electrostatic latent image, and toner is supplied to the electrostatic latent image to obtain a visible image (a toner image). The toner image is transferred onto a conveyed transfer material 52 at a transfer apparatus 51 disposed opposite to the photosensitive drum 50.

A pre-transfer roller 53 for guiding the transfer material 52 to a transfer position of the photosensitive drum 50 is provided so as to oppose the photosensitive drum 50 before a transfer is performed. The pre-transfer roller 53 rotates to smoothly send the transfer material 52 to the photosensitive drum 50 while decreasing the running resistance of the transfer material 52. By the action of the pre-transfer roller 53, the transfer material 52 that has been sent adheres to the photosensitive drum 50. Then, the toner image formed on the photosensitive drum 50 is transferred onto the transfer material 52 as a result of corona discharge by a discharging member 55 (a corona discharging wire) of a transfer unit 54 which constitutes the transfer apparatus 51.

Accordingly, the transfer material 52 guided to the transfer position of the transfer apparatus 51 provided so as to oppose to the photosensitive drum 50 is sent by the action of the pre-transfer roller 53 in a stable condition. The pre-transfer roller 53 is disposed in order to decrease the running resistance of the transfer material 52, as described above.

The transfer material 52 is guided to the transfer position along a pre-transfer guide 56, as shown in FIG. 11, before being sent to a transfer area by the pre-transfer roller 53. The pre-transfer guide 56 is shaped into a form of comb-teeth so that a tip end thereof is positioned between the photosensitive drum 50 and the pre-transfer roller 53. The pre-transfer guide 56 is provided in order that the comb-teeth tip end prevents the rear end of the transfer material 52 from suddenly slipping off after passing by the pre-transfer roller 53 to guide the transfer material. Accordingly, the transfer material 52 is guided along the surface of the guide 56, and thereafter smoothly sent to the transfer position by the pre-transfer roller 53.

As described above, in the transfer apparatus disposed to a conventional image forming apparatus, a discharging unit (a transfer unit) which performs corona discharge from the back of the transfer material 52, the pre-transfer guide 56, the pre-transfer roller 53, a supporting portion thereof, and a post-transfer guide 57 for guiding a sheet which has been transferred are formed separately from each other. When manufacturing a transfer apparatus by assembling the separated components as shown above, it is extremely inconvenient to assemble and position them. Accordingly, the total cost including cost for manufacturing the transfer apparatus extremely increases.

Furthermore, it is required to accurately position the pre-transfer guide 56 and the discharge member (the discharge wire) 55 in relation to each other as well as the pre-transfer guide 56 and the post-transfer guide 57 in relation to each other, before a transfer is performed. If any transfer failure is caused, or transfer efficiency is lowered due to the deviation between a position where a transfer material is guided to the photosensitive drum 50 and a position where corona discharge is performed, a normal transfer may not be performed. Since the separated components as shown above are fabricated separately from each other, means for positioning or for positional adjustment is required, resulting in increase in cost.

SUMMARY OF THE INVENTION

In view of the above problems, an object of the present invention is to provide a transfer apparatus in which the assembly thereof is simplified while a pre-transfer guide and so on are positioned more accurately and positional adjustment is not required.

In a first aspect of the invention, a transfer apparatus comprising a transfer unit for transferring an image formed on a transfer medium onto a conveyed transfer material, further comprises:

a pre-transfer guide for guiding the transfer material into a transfer area between the transfer medium and the transfer unit; and a post-transfer guide for guiding the transfer material out of the transfer area between the transfer medium and the transfer unit, the post-transfer guide being integrated with the pre-transfer guide to constitute a transfer holder, wherein the transfer unit includes a wire for performing corona discharge and is attached to the transfer holder.

According to the first aspect of the invention, as shown in FIG. 1, a transfer unit 9 having a corona discharge wire **9*a* inside a corona discharge area surrounded by shield members 9*b*-1 and 9*b*-2 is attached to a transfer holder 40 constituted by integrating a pre-transfer guide 31 and a post-transfer guide 34. In this structure, since an operation of respectively incorporating the pre-transfer guide, the post-transfer guide and the transfer unit is not necessary, the assembly operation is simplified. Moreover, the positional relationship between the pre-transfer guide and the post-transfer guide in the transfer area of the transfer unit 9** becomes constant, whereby it is no longer necessary to adjust the positions thereof.

In a second aspect of the invention, the transfer holder has fixing portions for connecting the pre-transfer guide and the post-transfer guide to integrate into one, and for fixing both ends of the wire thereto, the fixing portions being formed at both side ends of the transfer area of the transfer holder, and the transfer unit is inserted into a space between the pre-transfer guide and the post-transfer guide to attach thereto.

According to the second aspect of the invention, the positional relationship between the corona discharge wire and the pre/post-transfer guides is maintained to be constant, whereby the positioning thereof is no longer required. Accordingly, transfer efficiency can be improved and a good transfer can be achieved.

In a third aspect of the invention, a transfer apparatus comprising a transfer unit for transferring an image formed on a transfer medium onto a conveyed transfer material, further comprises:

a pre-transfer guide for guiding the transfer material into a transfer area between the transfer medium and the transfer unit; and a post-transfer guide for guiding the transfer material out of the transfer area between the transfer medium and the transfer unit, the post-transfer guide being integrated with the pre-transfer guide to constitute a transfer holder, wherein the transfer unit is made of shield members, including a pre-transfer roller supported between the transfer area and the pre-transfer guide, supporting portions provided on a part of the shield member to support the pre-transfer roller, and a wire for performing corona discharge, and attached to the transfer holder.

According to the third aspect of the invention, the same action and effect as described above can be produced as described in the transfer apparatus structured in the aforementioned manner. Apart from that, a transfer roller is disposed between the pre-transfer guide and the transfer unit, and the pre-transfer roller is supported by supporting portions which are formed on shield members constituting the transfer unit. In this structure, the positional relationship between the transfer unit and the pre-transfer roller becomes accurate. Furthermore, since the positional relationship between the corona discharge wire and the pre-transfer roller becomes accurate as well, an efficient transfer can be performed in accordance with timing when a transfer material is guided to the transfer area.

In a fourth aspect of the invention, the transfer holder has fixing portions for connecting the pre-transfer guide and the post-transfer guide to integrate into one and for fixing both ends of the wire thereto, the fixing portions being formed at both side ends of the transfer area of the transfer holder, and positioning ribs, are formed on the fixing portions.

According to the fourth aspect of the invention, the positional relationship between the corona discharge wire and the pre-transfer roller becomes more accurate. Moreover, since the supporting portions for the pre-transfer roller are accurately positioned when inserting the transfer unit into the transfer holder, the attaching operation of the transfer unit to the transfer holder becomes easier.

In a fifth aspect of the invention, the transfer apparatus structured in the above manner is characterized in that, as shown in FIG. 9, for example, a positioning member 49 for positioning the transfer holder is provided outside the transfer area of the transfer unit 9, and a positioning rib 31*b* is disposed to the transfer holder corresponding to the positioning member. According to the fifth aspect of the invention, the positional relationship between the pre/post-transfer guides and the transfer unit obviously becomes accurate.

In a sixth aspect of the invention, the transfer apparatus is characterized in that, as shown in FIG. 9, the positioning rib 31*b* is placed on the pre-transfer guide 31, and the positioning member 49 of the transfer unit is a groove 49 which the positioning rib 31*b* is fit into. According to the sixth aspect of the invention, a fit-into operation enables to easily position both of the rib and the groove.

According to the invention, the transfer apparatus has such a structure that the shield members constituting the transfer unit are inserted to attach to the transfer holder constructed by integrating the pre-transfer guide and the post-transfer guide. Therefore, it is not required to position the pre-transfer guide and the post-transfer guide, with the result that the assembly operation is remarkably simplified.

In addition, since the transfer holder is integrated including the fixing portions of the corona discharge wire, the positional relationship between the corona discharge wire and the pre/post-transfer guides becomes accurate, whereby more efficient transfer can be performed. Especially, since means for positioning or adjusting of position is no more required, it enables to largely decrease the total cost including assembly cost.

Furthermore, since the transfer holder and the transfer unit are designed to be accurately positioned, the accuracy of the positional relationship between the corona discharge wire and the pre-transfer guide is improved. This configuration realizes reliable guidance of the transfer material to the transfer area, thereby enhancing transfer efficiency.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
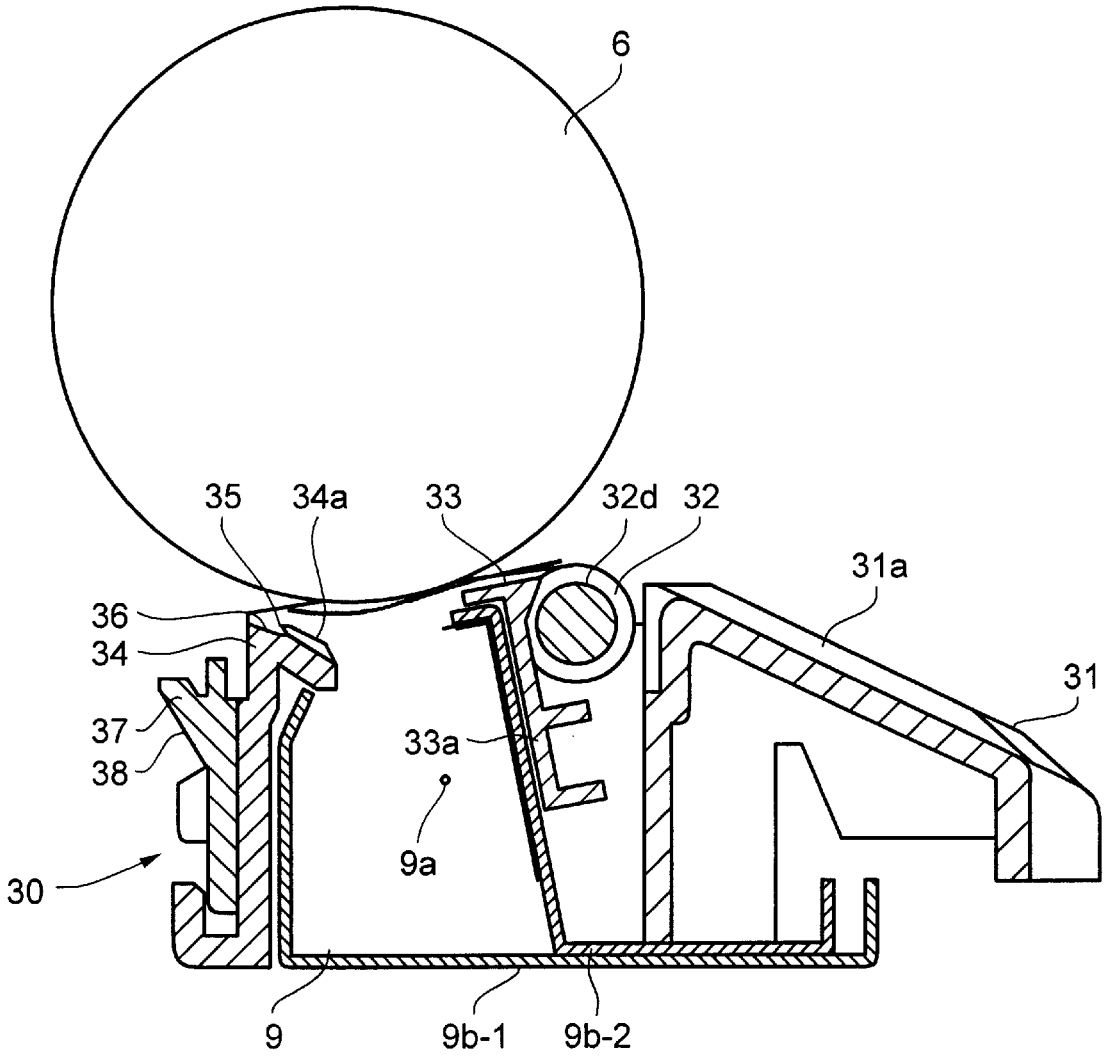
FIG. 1 is a section view entirely showing a transfer apparatus of the present invention for transferring an image to a transfer material.

Now referring to the drawings, preferred embodiments of the invention are described below.

Figure 2:
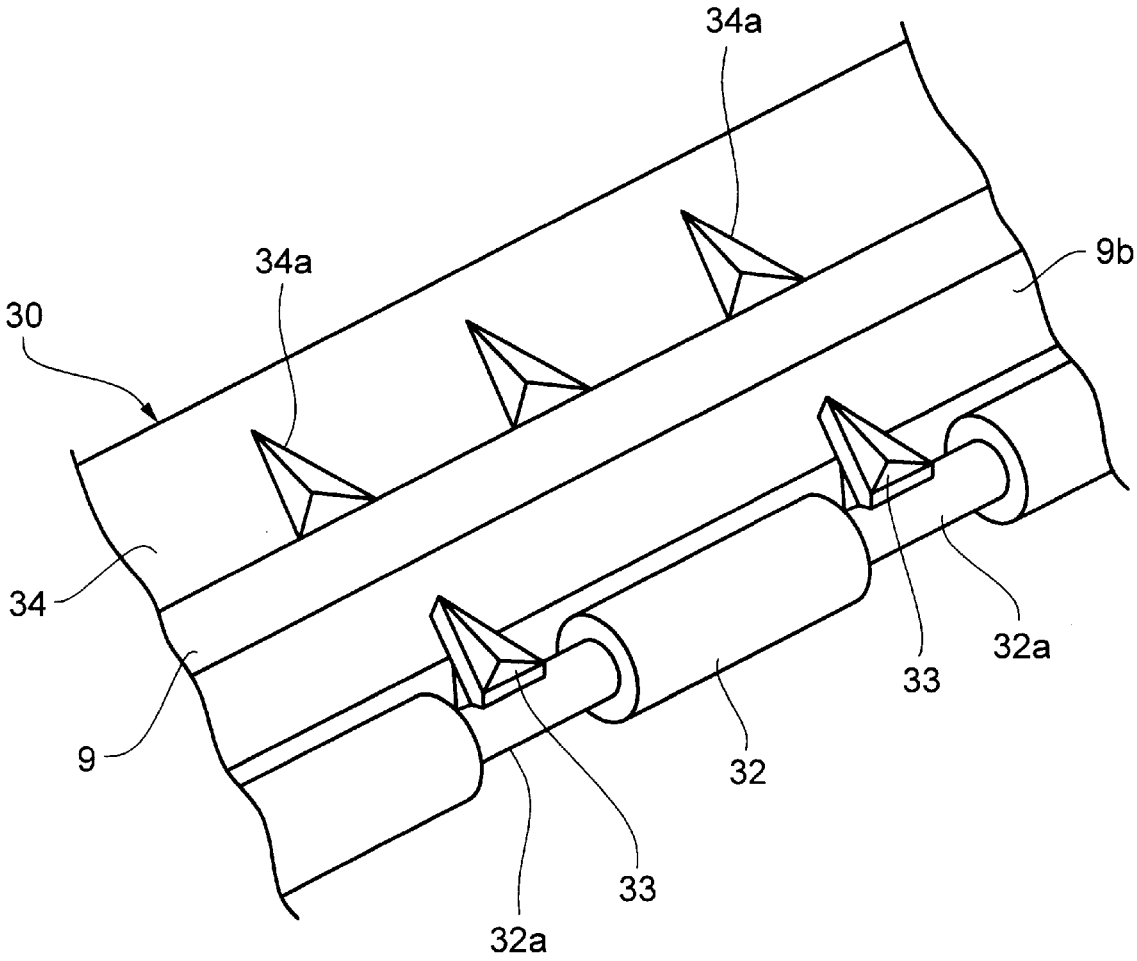
FIG. 2 is a perspective view showing an essential portion of the transfer apparatus of FIG. 1.
Figure 3:
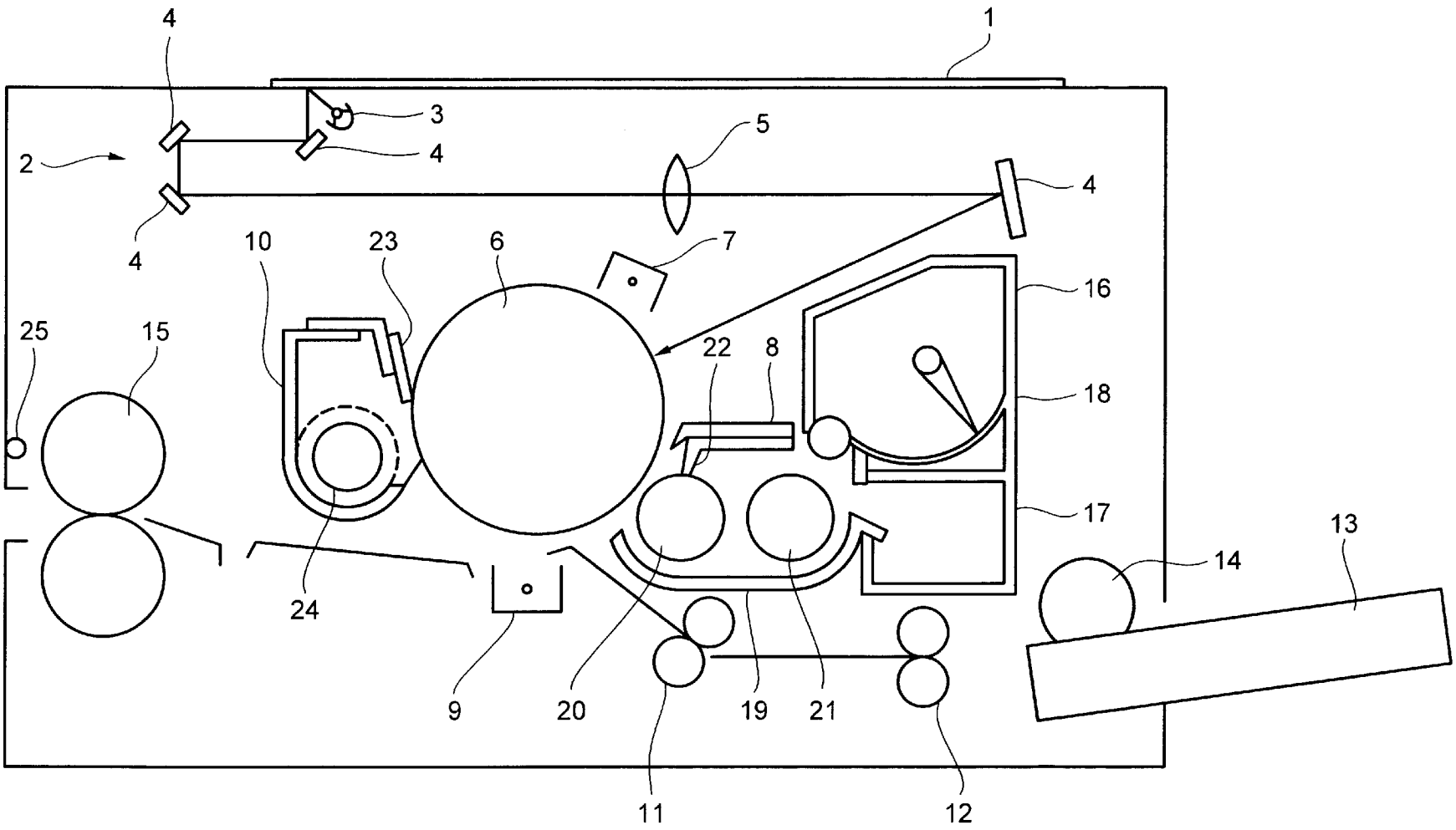
FIG. 3 is a section view showing an entire structure of an image forming apparatus, specifically a copying machine, which comprises the transfer apparatus of the invention.

Referring to the drawings, preferred embodiments of the invention will be described below. FIG. 1 is a section view showing an example of the structure of a transfer apparatus according to the invention, and FIG. 2 is a perspective view thereof. FIG. 3 is a section view showing the entire structure of an image forming apparatus comprising the transfer apparatus of the invention.

First, an image forming apparatus relating to the invention will be described with referring to FIG. 3. In the main body of the image forming apparatus, a document glass plate 1 is disposed at the top thereof, and an exposure optical system 2 is disposed under the document glass plate 1. The exposure optical system 2 comprises a light source lamp 3 which scans a document (not illustrated) set on the document glass plate 1 with irradiating light on the document, a plurality of reflecting mirrors 4 which guide reflection light from the document to the surface of a photosensitive drum 6, and a lens unit 5 which is positioned on the optical path of the reflection light.

Around the perimeter of the photosensitive drum 6, an electrifying charger (an electrifying unit) 7 for electrifying the surface of the photosensitive drum 6 at a predetermined potential, an eraser (not illustrated) for erasing unnecessary areas among images and on sides, a developing device 8 for developing an electrostatic latent image which is formed on the surface of the photosensitive drum 6, a transferring charger (a transfer unit) 9 for transferring a toner image which is formed on the surface of the photosensitive drum 6 onto a transfer material such as sheet, a cleaning device 10 for removing unnecessary toner which remains on the surface of the photosensitive drum 6, and an electricity eliminator (not illustrated) are disposed in this order.

Furthermore, on the paper-inserting side (right side in FIG. 3) with respect to the photosensitive drum 6, a timing roller 11 which controls the conveyance of the transfer material at a predetermined timing, a conveying roller 12, a paper feeding cassette 13, and a paper feeding roller 14 are provided. On the paper-ejecting side with respect to the photosensitive drum 6, a fixing device 15 for causing the toner image transferred onto a transfer material to be fixed as a permanent image onto the transfer material.

The developing device 8 comprises a developer supplying unit 16 for supplying developer into a developer vessel 19 which contains developer, and a developer recovering vessel 17 for recovering developer discharged from the developing device 8. The developer supplying unit 16 and the developer recovering vessel 17 are integrated with each other to form a developer recovering unit 18, which can be attached to and detached from the developing device 8.

The developing device 8 comprises the developer vessel 19 having a vessel-shape. Inside the developer vessel 19, a magnetic roller 20 and an agitation roller 21 are provided as well as developer which are composed of carrier and toner is contained. The carrier is made of a magnetic substance, having a resin coat layer which suppresses the adhesion of the toner onto the surface. When agitated together with the toner, the carrier causes the toner to be frictionally electrified so that the toner is adsorbed to the electrostatic latent image on the photosensitive drum 6.

The magnetic roller 20 adsorbs the carrier by magnetic force and forms a magnetic brush to convey the carrier thereby supplying the toner adhered to the carrier by Coulomb force to the photosensitive drum 6. The length of bristles of the magnetic brush is regulated by a doctor 22. The agitation roller 21 agitates the developer in the developer vessel 19 and supplies the developer to the magnetic roller 20.

The cleaning device 10, as shown in FIG. 3, comprises a cleaning blade 23 which scrapes the toner residue off the surface of the photosensitive drum 6, and a conveying screw 24 which contains the toner scraped off by the cleaning blade 23 to convey in one direction.

Next, a copying operation will be briefly described. When a copy-start switch (not illustrated) is turned on during standby state after finishing a warm-up, a document which is set on the document glass plate 1 is exposed and scanned by the light source lamp 3 of the exposure optical system 2, and then reflected light from the document is irradiated onto the photosensitive drum 6 through the reflecting mirrors 4 and the lens unit 5. As a result, an electrostatic latent image is formed on the surface of the photosensitive drum 6 electrified at a predetermined potential by the electrifying unit 7. The electrostatic latent image is developed by use of toner which is supplied from the developing device 8. A toner image which is developed on the surface of the photosensitive drum 6 is transferred onto a transfer material which is fed from the paper-feeding cassette 13 and fixed onto the transfer material by the fixing device 15. In this manner, a copy image corresponding to a document image can be obtained on the transfer material.

In FIG. 3, the image forming apparatus is structured to be capable of opening and closing in both directions upward and downward along a conveying path of a transfer material about an opening and closing spindle 25 which is disposed on the side of the fixing device 15, so that a paper jam may be resolved. A transfer material which is jamming in the conveying path can be easily removed by releasing an upper unit from a lower unit.

(Structure of the transfer apparatus of the invention)

Referring to FIGS. 1 and 2, preferred embodiments of the invention in the above structure will be described below.

First, the structure of a transfer apparatus of the invention will be described with reference to FIG. 1. A transfer apparatus 30 comprises the transfer unit 9 for performing corona discharge, and a pre-transfer guide 31 which is made of an insulating resin and guides a transfer material to a transfer position (a transfer area) where the transfer unit 9 and the photosensitive drum 6 are opposite to each other. In particular, the pre-transfer guide 31 supports the back of a transfer material along the conveying direction, and reduces the running resistance in the conveying direction, a plurality of projecting ribs 31a are provided on the top face (a guide face which contacts with the back of a transfer material) thereof in the width direction. The pre-transfer guide 31 is inclined in the upward direction so as to send a transfer material specifically to the photosensitive drum 6.

The transfer unit 9 includes a corona discharge portion (a corona discharge wire) 9*a* to which a high voltage is supplied so as to perform corona discharge, and shield members 9*b*-1 and 9*b*-2 which surround the discharge wire 9*a*, having an open area facing to the photosensitive drum 6, and being formed by two metal plates or the like. A rotatable pre-transfer roller 32 is disposed for sending a transfer material from the transfer area of the transfer unit 9 toward the downstream side with respect to a direction in which a transfer material is conveyed. The pre-transfer roller 32 is placed between the pre-transfer guide 31 and the transfer unit 9.

Furthermore, between the pre-transfer roller 32 and the transfer unit 9, members 33 for preventing a transfer material from being crimped are disposed so as to support the back of the transfer material and guide to the transfer position. The anti-crimping members 33, as shown in FIG. 2, are formed in a pointed shape so as to partially contact with the back of a transfer material, and are caused to contact with the back of a transfer material at the vertex thereof. The plurality of anti-crimping members 33 are disposed along the direction of the rotation axis of the photosensitive drum 6, and positioned corresponding to small-diameter rollers 32*a* which are co-axial with the pre-transfer roller 32 separated by a predetermined space.

On the downstream side of the transfer unit 9 to which a transfer material is conveyed, a post-transfer guide 34 which is made of an insulating resin and guides a transfer material left from the surface of the photosensitive drum 6. On the surface of the post-transfer guide 34, i.e., on the surface facing a transfer material, a plurality of ribs 34*a* having a pointed shape which is the almost identical to the shape of the anti-crimping members 33 are integrally formed with and uniformly spaced. On the post-transfer guide 34, a step portion 36 is formed at a lower position by one step with respect to a vertex 35 of the tip end which supports the back of the transfer material and passes a transfer material by. The step portion 36 is provided corresponding to each end of a transfer material which passes by.

A discharge plate 38 having a blade-teeth form for discharging is fixed onto an (resin) insulating member 37 which is disposed on the back of the post-transfer guide 34, i.e., on the downstream side. An electrical charge is to be eliminated at the discharge plate 38 from the back of a transfer material after transferred.

An operation of transferring a toner image onto a transfer material in the above structure will be described below. First, a transfer material is conveyed via the timing roller 11 shown in FIG. 3 to the transfer area of the transfer apparatus 30. The tip end of the transfer material is guided along the pre-transfer guide 31 of the transfer apparatus 30, and then sent to the surface of the photosensitive drum 6 via the pre-transfer roller 32 that is disposed before the transfer unit 9.

The tip end of the transfer material is guided to the transfer area in accordance with the rotation of the photosensitive drum 6. While gradually reaching an opening of the shield members 9*b*-1 and 9*b*-2 of the transfer unit 9, the transfer material undergoes an effect of corona discharge by the corona discharge wire 9*a*. At this time, the back of the transfer material is electrified at a predetermined potential, specifically at the opposite polarity to that of the toner, whereby the toner adhering to the photosensitive drum 6 moves to the transfer material side.

When reaching an area of the opening of the shield member 9*b*-1 of the transfer unit 9 after continuing the above operation, the tip end is guided along the post-transfer guide 34, and then to the fixing device 15 when leaving the photosensitive drum 6 via the vertex 35 of the post-transfer guide 34.

After the rear end of the transfer material passes by the pre-transfer roller 32, the transfer material is guided so as to contact with the anti-crimping member 33. The member 33 is interposed between the shield member 9*b*-2 and the pre-transfer roller 32, without instantly contacting with the fringe of the opening at the top of the shield member 9*b*-2. This prevents a transfer failure due to such an incident as being crimped which is brought about when the rear end of the transfer material is off the pre-transfer roller 32 and then slips off.

(An embodiment of the transfer apparatus of the invention)

Next, an embodiment of the transfer apparatus 30 according to the invention will be described below. In particular, the transfer apparatus 30 of the present invention has a structure which realizes the simplicity of the positioning of the pre-transfer guide 31 and the post-transfer guide 34 including the transfer unit 9 as well as the assembly thereof.

In the embodiment of the invention, at least the pre-transfer guide 31 and the post-transfer guide 34 are molded in one piece by an insulating resin. The transfer apparatus 30 is constructed so as to have a transfer unit structure as a result of fixing the one-piece resin transfer holder 40 to the shield members 9*b*-1 and 9*b*-2 composing the transfer unit 9 by use of screws or the like.

Figure 4:
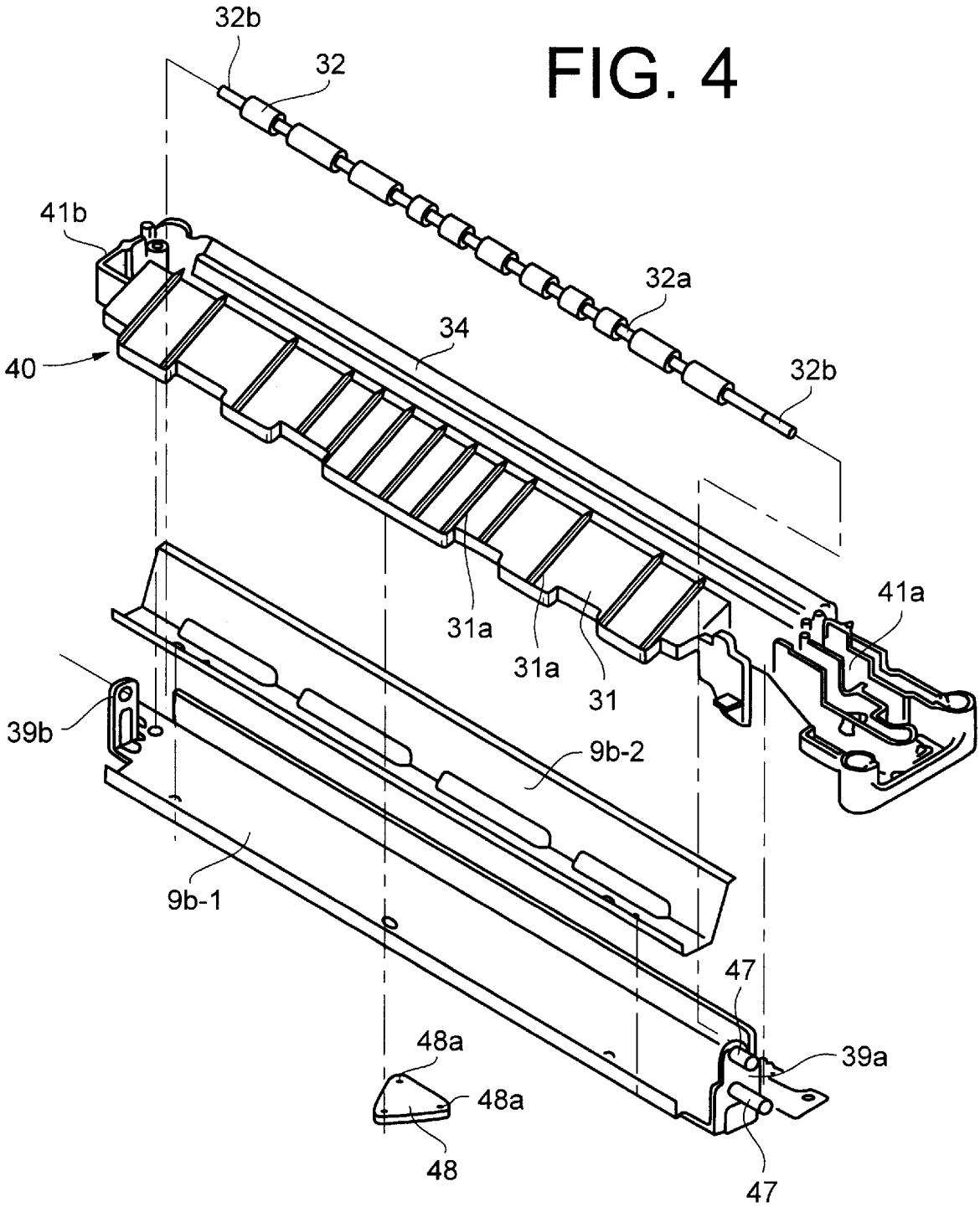
FIG. 4 is an exploded perspective view showing an assembled transfer apparatus of the invention.

The transfer holder 40 formed by molding in one piece the pre-transfer guide 31 and the post-transfer guide 34, as shown in FIG. 4, is molded in one piece including wire fixing portions 41*a* and 41*b* which support and fix the ends of the corona discharge wire 9*a* at each end thereof. In other words, the transfer holder 40 is formed by molding in one piece the pre-transfer guide 31, the post-transfer guide 34, and the wire fixing portions 41*a* and 41*b*. A space for interposing the transfer unit 9 is formed with the transfer holder 40 surrounding from four directions.

In the space of the transfer holder 40 formed by molding in one piece the wire fixing portions 41*a* and 41*b*, the pre-transfer guide 31 and the post-transfer guide 34, the transfer unit 9 is inserted and integrated to constitute the transfer apparatus 30.

A rotation axis 32*b* for disposing the pre-transfer roller 32 in a rotatable manner, as shown in FIG. 4, for example, is supported in a rotatable manner by a pair of supporting portions 39*a* and 39*b* which are formed by bending a part of both ends (the direction of the rotation axis of the photosensitive drum 6) of the shield member 9*b*-1. The supporting portions 39*a* and 39*b* are formed by bending 90 degrees a part of both ends of the shield member 9*b*-1. Each supporting portion has a hole to support the rotation axis 32*b* of the pre-transfer roller 32 in a rotatable manner.

In FIG. 4, the shield members 9*b*-1 and 9*b*-2 are described as follows. The shield member 9*b*-2 having a substantially L-shaped section is superposed on the shield member 9*b*-1 having the supporting portions 39*a* and 39*b*, whereby both ends are fixed by screws or the like. This enables formation of a housing-shape shield portion in which a face opposite to the photosensitive drum 6 is opened as shown in FIG. 1. Inside the shield portion, the corona discharge wire 9*a* for performing corona discharge is provided with being insulated and separated from the shield members 9*b*-1 and 9*b*-2.

In order to be disposed in the shield portion surrounded by the two shield members 9*b*-1 and 9*b*-2, both ends of the corona discharge wire 9*a* are fixed by screws or the like to the wire fixing portions 41*a* and 41*b* of the transfer holder 40 that is formed in a manner that the pre-transfer guide 31 and the post-transfer guide 34 that are made of an insulating member are molded into one piece by use of resin.

Figure 5:
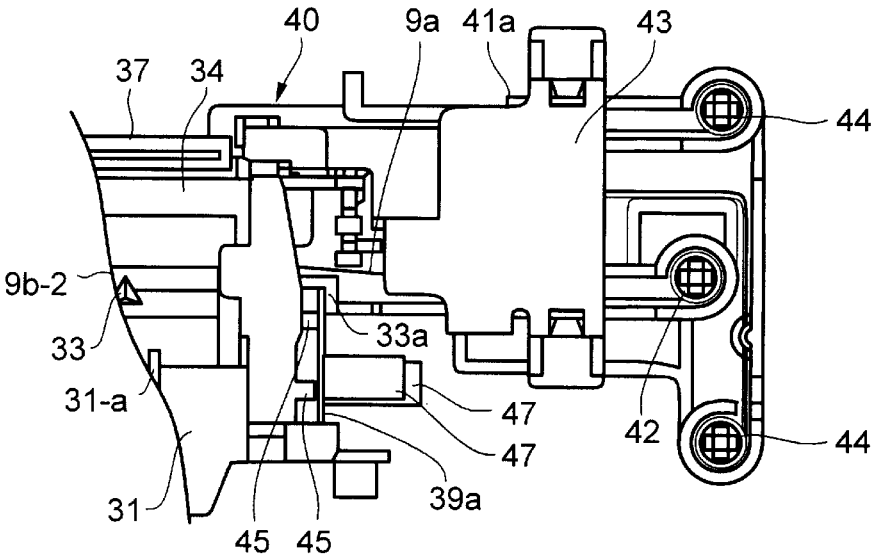
FIG. 5 is a plan view showing a fixing portion of a corona discharge wire of the transfer apparatus of the invention.

On the side of the wire fixing portion 41*a* for fixing the corona discharge wire 9*a*, as shown in FIG. 5, a supply terminal 42 for supplying a high voltage is disposed, thereby electrically connected with a portion to which the corona discharge wire 9*a* is fixed. FIG. 5 shows that the portion to which one end of the corona discharge wire 9*a* is fixed is covered by a lid 43. This structure enables the supply of high voltage to the corona discharge wire 9*a*.

Furthermore, on the side of the wire fixing portion 41*a*, ground terminals 44 for connecting the shield members 9*b*-1 and 9*b*-2 respectively to ground portions of the image forming apparatus are disposed. The ground terminals 44 are electrically connected to the shield members 9*b*-1 and 9*b*-2.

Accordingly, as a result of placing the transfer apparatus 30 constructed in the above manner to the transfer position of the image forming apparatus, the terminal 42 is connected to a high-voltage source and the terminals 44 are connected to the ground terminals at a ground potential, whereby corona discharge is performed between the terminals described above and the shield members 9*b*-1 and 9*b*-2 by means of the corona discharge wire 9*a*.

On the other hand, the shield members 9*b*-1 and 9*b*-2 combined in a housing shape are inserted into the space that is formed in the one-piece resin transfer holder 40 from the opposite side of a face which is opposite to the photosensitive drum 6, whereby the transfer apparatus 30 is constructed as shown in FIG. 1. In order to easily insert the shield members 9*b*-1 and 9*b*-2 composing the transfer unit 9, the shield members 9b are structured so that the width thereof becomes narrow in the inserting direction as shown in the drawing. Corresponding to the above structure, the transfer holder 40 is formed. Particularly in the embodiment, the anti-crimping members 33 that guide a transfer material are also molded in one piece. Therefore, a perpendicular portion (a seal member 33*a*) of the anti-crimping members 33 is formed in an inclining state, with the result the shield members 9*b*-1 and 9*b*-2 can be easily inserted, and the transfer holder 40 and the shield members 9*b*-1 and 9*b*-2 composing the transfer unit 9 can be easily positioned.

Referring to FIG. 4, the assembly procedure of the transfer apparatus 30 will be described. First, the two shield members 9*b*-1 and 9*b*-2 are fixed to each other by use of screws or the like, thereby assembling the shield portion of the transfer unit 9. The shield portion is inserted from the bottom into the space of the one-piece transfer holder 40. At this time, since the shield member 9*b*-2 is inclined, and corresponding to this inclination, the seal member 33*a* shown in FIG. 6 of the anti-crimping portions on the transfer holder 40 side is disposed in an inclining state, the shield portion can be easily inserted along the seal member 33a, and the transfer unit 9 and the transfer holder 40 can be easily positioned.

In this condition, the transfer unit 9 and the transfer holder 40 are fixed by screws or the like, and both ends of the corona discharge wire 9*a* are mounted and fixed onto the wire fixing portions 41*a* and 41*b* of the transfer holder 40. Since a conventional method for mounting and fixing wires can be utilized in the invention and such a method is not directly related to the invention, the detailed description of the method will be omitted.

Finally, the axis 32*b* of the pre-transfer roller 32 is mounted onto the supporting portions 39*a* and 39*b* that are disposed on the shield member 9*b*-1. This completes the assembly of the transfer apparatus 30.

In this structure, the positional relationship between the corona discharge wire 9*a* and the pre/post-transfer guides 31 and 34 becomes proper, with the result that the positioning accuracy thereof is improved. Since the transfer unit 9 is only inserted and fixed into the transfer holder 40, the assembly procedure is very simplified. Therefore, there is no need to take any procedure for positioning or conduct such an operation as adjusting a position. Accordingly, manufacturing cost can be greatly reduced.

(Another embodiment of the invention)

In FIG. 4, supporting parts for supporting the pre-transfer roller 32 in a rotatable manner are provided on the shield member 9*b*-1. The positioning when inserting the supporting parts, specifically the supporting portions 39*a* and 39*b*, into the transfer holder 40 becomes quite effective. In other words, by ensuring the positional relationship between the pre-transfer roller 32 and the transfer unit 9, a point to guide a transfer material into the transfer area can be properly designated. This resolves a transfer failure as well as improves a transfer efficiency.

In the invention, as mentioned above, the supporting parts, that is, the supporting portions 39*a* and 39*b* of the pre-transfer roller 32 are provided on the shield member 9*b*-1. An embodiment for easily inserting and positioning the supporting portions 39*a* and 39*b* will be described below.

Figure 6:
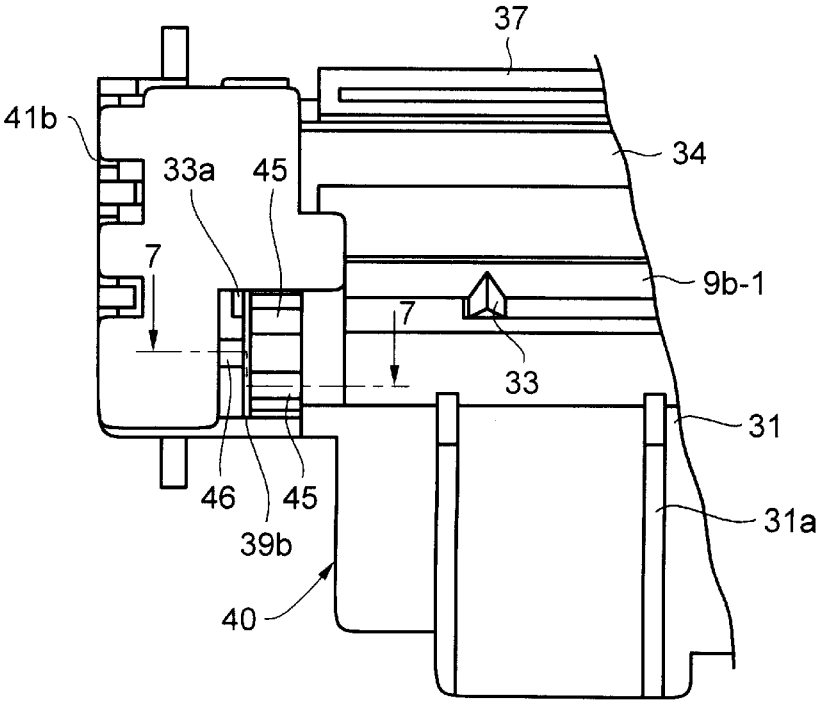
FIG. 6 is a plan view showing another fixing portion of the corona discharge wire of the transfer apparatus of the invention.

The supporting portions 39*a* and 39*b* for supporting the pre-transfer roller 32 are formed on the shield member 9*b*-1. With a view to easily inserting and positioning the supporting portions 39*a* and 39*b*, positioning ribs 45 and 46 are provided to the respective wire fixing portions 41*a* and 41*b* constituting the transfer holder 40. The positioning ribs 45 and 46, as shown in FIGS. 5 and 6, guide the insertion of the supporting portions 39*a* and 39*b* that are erected with respect to the shield member 9*b*-1. FIG. 6 shows that a space where the supporting portion 39*b* is inserted is formed in the respective wire fixing portions 41*a* and 41*b*.

Figure 7:
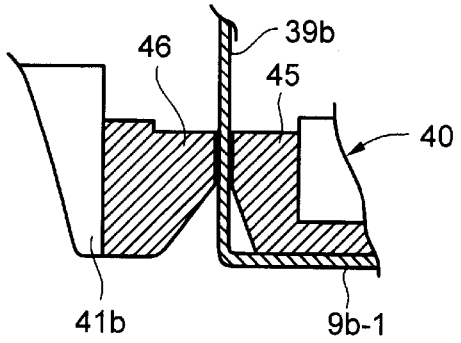
FIG. 7 is a section view of FIG. 6 taken on line A—A.

The positioning ribs 45 and 46 provided on the wire fixing portion 41b are disposed so as to oppose to each other and ensure a space where the supporting portion 39*b* is inserted. FIG. 7 shows a section view taken on line A—A of FIG. 6. The positioning ribs 45 and 46 are formed in a manner that, at the bottom of the transfer holder 40, they are partially cut away and the insertion face thereof is tapered.

This structure, when inserting the transfer unit 9 composed by the shield members 9*b*-1 and 9*b*-2 from the bottom of the transfer holder 40, enables to easily and reliably insert and guide the supporting portion 39*b* that is formed on the shield member 9*b*-1 and supports the pre-transfer roller 32. Accordingly, the supporting portion 39*b* for supporting the pre-transfer roller 32, when inserting the transfer unit 9 into the transfer holder 40, are accurately positioned by both of the positioning ribs 45 and 46. As a result, the pre-transfer roller 32 and the transfer unit 9 can be positioned with an accurate positional relationship. Furthermore, since the pre-transfer roller 32 is supported by the shield member 9*b*-1, the accuracy of the positional relationship thereof with respect to the corona discharge wire 9*a* is improved and the accuracy of the positional relationship between the pre-transfer guide 31 and the post-transfer guide 34 is also improved.

In this structure, the other supporting portion 39*a* is inserted into transfer holder 40 guided by the positioning rib 45 as shown in FIG. 5. On the side of the supporting portion 39*a*, a positioning pin 47 is provided in order to place the transfer apparatus 30 into the main body of the image forming apparatus. Since the transfer apparatus 30 is positioned by use of the pin 47, the other positioning rib 46 cannot be provided in a manner of opposing to the positioning rib 45 from the opposite side. Therefore, in order to guide the supporting portion 39*b*, the seal member 33*a* formed by extending the insulating member forming the anti-crimping member 33 is constructed as the positioning rib 46. In particular, the seal member 33*a* is interposed between the supporting portions 39*a*, 39*b* and the corona discharge wire 9*a*. In FIG. 6, the fixing portion for the other end of the corona discharge wire 9*a* is covered by the lid so as not to be visually observed.

Accordingly, also on the side of the supporting portion 39*a* having the positioning pin 47, since the shield members 9*b*-1 and 9*b*-2 are inserted into the transfer holder 40, the positioning thereof and an inserting operation are simplified and ensured.

As referred to above, FIG. 4 shows that the two shield members 9*b*-1 and 9*b*-2 are fixed by screws or the like to form the shield portion in the above structure. From the bottom of the one-piece transfer holder 40, the shield portion is inserted. At this time, the supporting portions 39*a* and 39*b* of the shield member 9*b*-1 are inserted specifically along the positioning ribs 45 and 46 provided to the wire fixing portions 41*a* and 41*b* of the transfer holder 40, thereby being positioned. When the insertion of the shield portion into the transfer holder 40 is completed, both are fixed by screws or the like.

After that, the corona discharge wire 9*a* is fixed to both of the wire fixing portions 41*a* and 41*b*. When the axis 32*b* of the pre-transfer roller 32 is inserted into the holes of the supporting portions 39*a* and 39*b* of the shield member 9*b*-1, and is supported in a rotatable manner, the assembly is completed. Accordingly, with the above recited structure even when the positioning of the pre-transfer guide 31 and the post-transfer guide 34 or the positioning of the guides with respect to the transfer unit 9 is not performed, the positioning can be accurately performed. As a result, the assembly operation can be extremely simplified.

Furthermore, since the pre-transfer roller 32 is supported by the supporting portions 39*a* and 39*b* of the shield member 9*b*-1, the positioning thereof with respect to the transfer unit 9 can be performed more accurately.

Since the shield member 9*b*-1 supports the pre-transfer roller 32, corona discharge occurs between the pre-transfer roller and the corona discharge wire 9*a*. This causes electrification unevenness when electrifying the photosensitive drum 6. The pre-transfer roller 32, however, is positioned on an area which is off a corona discharge area, and which is on the rear of the shield members 9*b*-1, and 9*b*-2 whereby unevenness caused by corona discharge will not occur. Moreover, since the shield members 9*b*-1 and 9*b*-2 are inserted into the transfer holder 40 so that the insulating member (the seal member 33*a*) of the anti-crimping member 33 is interposed between the pre-transfer roller and the shield member 9*b*, unevenness caused by corona discharge can be avoided. In addition, at the fixing points of the corona discharge wire 9*a*, though the wire 9*a* opposes to the supporting portions 39*a* and 39*b*, the seal member 33*a* is interposed between them, with the result that unevenness caused by corona discharge is suppressed to occur in the above manner.

(An example of a method for fixing the transfer unit and the transfer holder)

As a method for fixing the transfer holder 40 and the transfer unit 9 formed by the shield members 9*b*, the above embodiment has shown an example in which both are fixed by use of screws.

Figure 8:
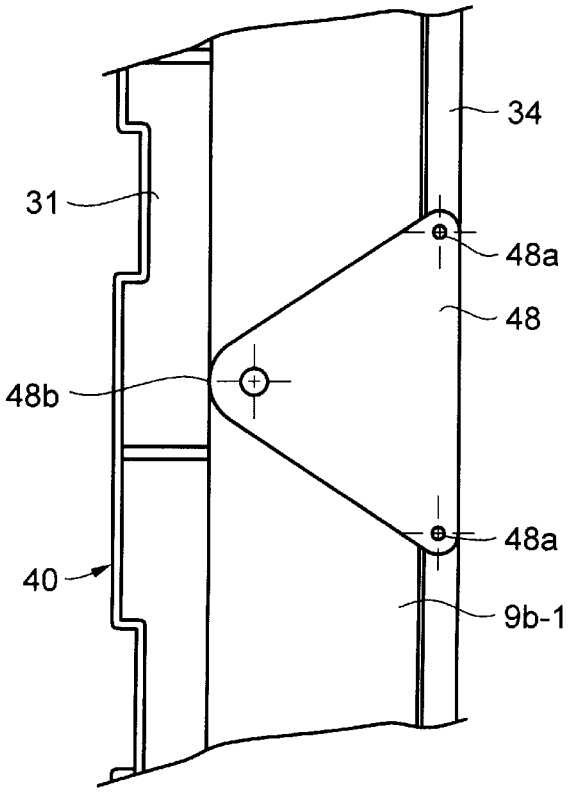
FIG. 8 is a bottom view showing an example of a method for fixing a transfer holder and a transfer unit in the transfer apparatus of the invention.

FIG. 8 shows another method for fixing. In FIG. 8, the holder 40 and the unit 9 are fixed with each other by use of a substantially triangular fixing member 48 onto the bottom of the transfer apparatus 30. For instance, two holes 48*a* which are disposed on the base side of the triangular fixing member 48 are put onto two projecting bosses which are disposed on the back of the post-transfer guide 34. The apex 48*b* of the fixing member 48 is held on the back of the pre-transfer guide 31 of the transfer holder 40, thereby stabilizing the positional relationship between the pre-transfer guide 31 and the post-transfer guide 34. Then the fixing member 48 is fixed by screws onto the shield member 9*b*-1. In this way, it can be realized to reinforce the transfer holder 40 by correcting a deformation due to the distortion of the resin, as well as ensure the positioning of the transfer holder 40 and the transfer unit 9.

In this method, the fixing member 48 is provided in such a manner as: the fixing member 48 is held on the post-transfer guide 34 constituting the transfer holder 40 and is fixed by screws onto the bottom of the shield member 9*b*-1 constituting the transfer unit 9. Accordingly, the transfer holder 40 and the transfer unit 9 can be positioned. The fixing member 48 may be fixed by screws onto the transfer unit 9 after being put on the bosses disposed on the side of the pre-transfer guide 31 of the transfer holder 40 and holding the apex thereof on the back of the post-transfer guide 34.

(Another example of a method for positioning the transfer unit and the transfer holder)

Figure 9:
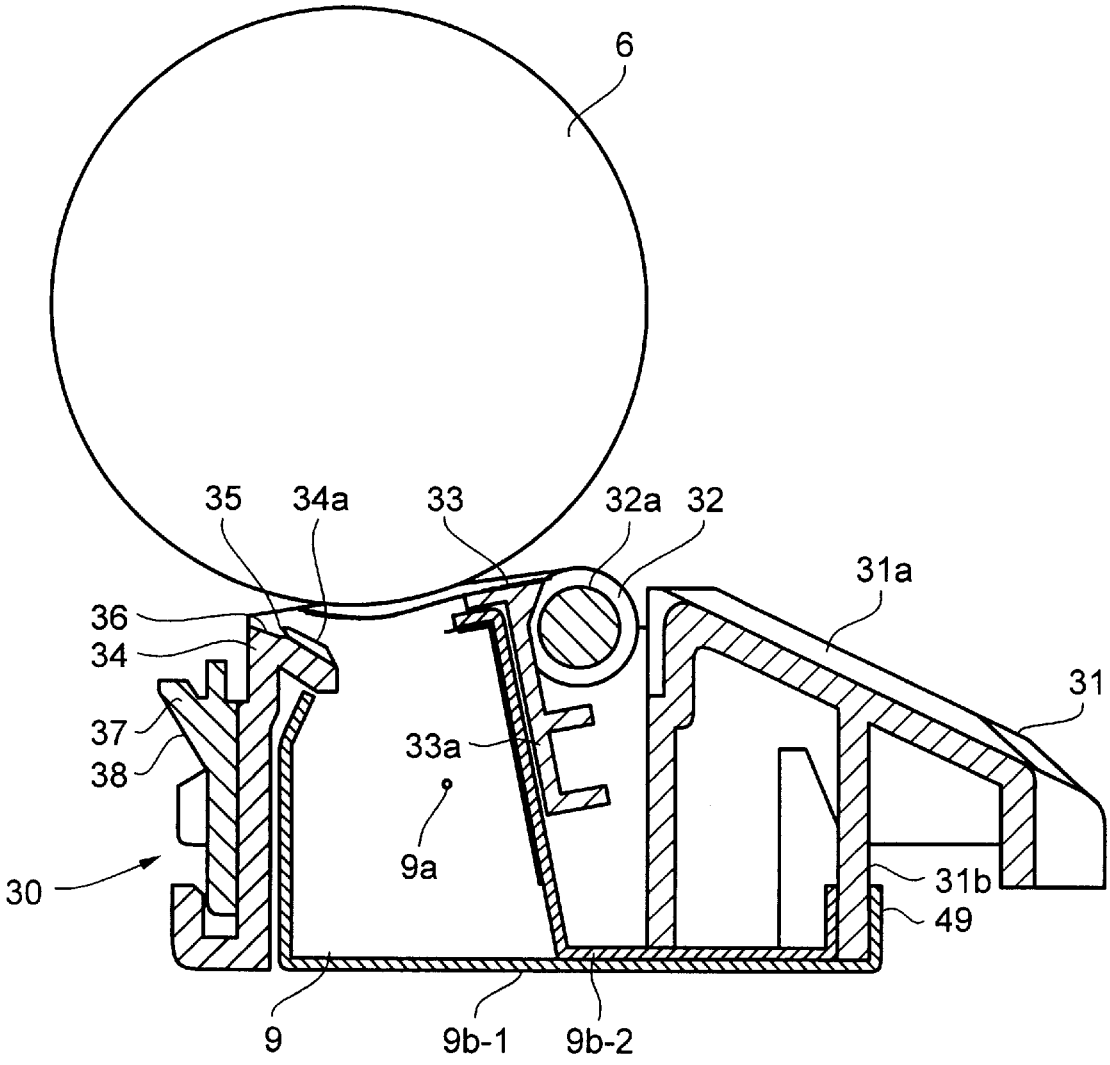
FIG. 9 is a section view showing an example of positioning the transfer holder and the transfer unit in the transfer apparatus of the invention.
Figure 10:
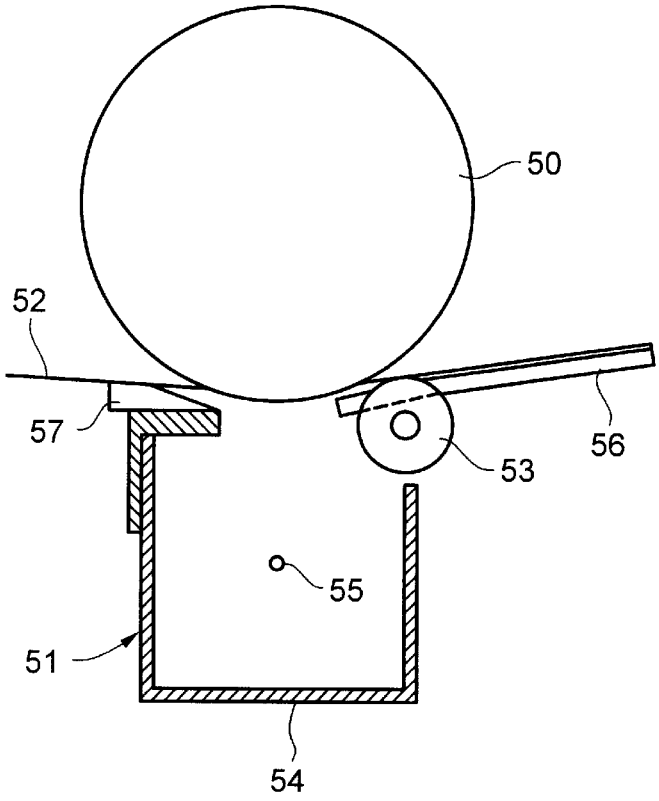
FIG. 10 PRIOR ART
FIG. 10 is a section view illustrating the structure of a conventional transfer apparatus.
Figure 11:
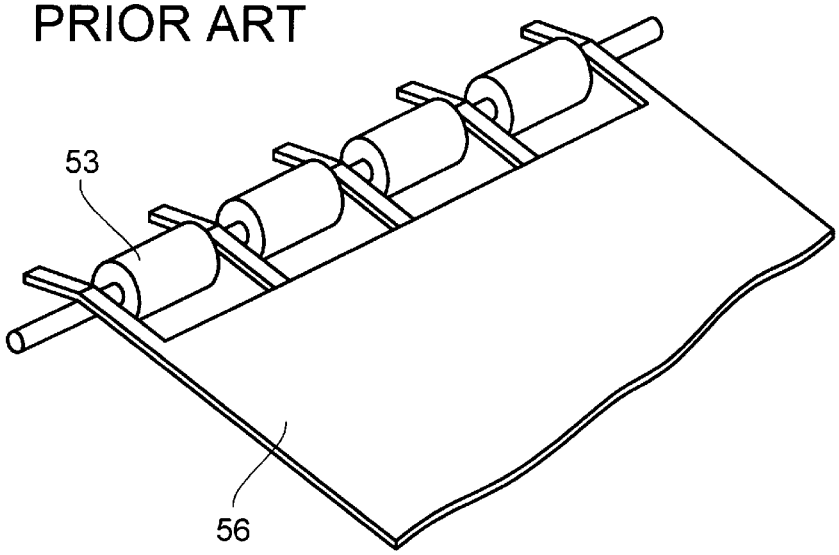
FIG. 11 PRIOR ART
FIG. 11 is a perspective view illustrating the structure of a conventional transfer apparatus.

FIG. 9 shows a method for improving the accuracy of positioning the shield members 9*b*-1, and 9*b*-2 specifically the transfer unit 9, and the transfer holder 40. In the pre-transfer guide 31 of FIG. 9, a fix-to-position rib 31*b* is vertically formed on the back of a surface where the transfer material guide ribs 31*a* for guiding a transfer material in the course of conveyance are disposed. The fix-to-position rib 31*b* is to be fit into a groove which is formed by assembling the two shield members 9*b*-1 and 9*b*-2.

The shield members 9*b*-1 and 9*b*-2, when fixed by screws or the like, form a groove for positioning at a part corresponding to an area where a transfer material off the transfer area is guided to the transfer area. Particularly, ends of the shield members 9*b*-1 and 9*b*-2 are bent. The bent portions of the ends are disposed in a manner that they are displaced from each other, whereby the positioning groove 49 is formed. The groove 49 is disposed so that the positioning rib 31*b* is fit thereto.

Accordingly, when the fix-to-position rib 31*b* formed specifically on the pre-transfer guide 31 of the transfer holder 40 is fit into the positioning groove 49 formed by the two shield members 9*b*-1 and 9*b*-2, both can be positioned. Furthermore, the positioning of the pre-transfer guide 31 and the shield members 9*b*-1, and 9*b*-2 as well as the positioning of the corona discharge wire 9*a* becomes more accurate.

As described above, the transfer apparatus 30 according to the invention is structured by inserting and installing the transfer unit 9 into the resin-made transfer holder 40 formed by integrating: the pre-transfer guide 31 for conveying and guiding a transfer material to the transfer area of the transfer unit 9; the post-transfer guide 34 for guiding the transfer material off the transfer area; and the wire fixing portions 41*a* and 41*b* for attaching and supporting the corona discharge wire 9*a*. In this structure, it is not required either to position the pre-transfer guide 31 for guiding a transfer material to the transfer area where the transfer unit 9 and the photosensitive drum 6 oppose to each other, or to position the post-transfer guide 34 for guiding the material off the transfer area. Therefore, a transfer material can be guided to the transfer area in a good condition with maintaining the mutual positional relationship, with the result that a preferable transfer can be performed. In this structure, means for positioning and an operation of adjusting the position are not required in particular, and the assembly operation is further simplified. As a consequence, the invention enables to largely decrease cost.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A transfer apparatus comprising:

a transfer unit for transferring an image formed on a transfer medium onto a conveyed transfer material, a pre-transfer guide for guiding the transfer material into a transfer area between the transfer medium and the transfer unit; and a post-transfer guide for guiding the transfer material out of the transfer area between the transfer medium and the transfer unit, the post-transfer guide being integrated with the pre-transfer guide as a single piece to constitute a transfer holder, the transfer holder being formed solely of insulating material, wherein the transfer unit includes a wire for performing corona discharge and the transfer unit is attached to the transfer holder.

2. The transfer apparatus of claim 1, wherein the transfer holder has fixing portions and both ends of the wire are connected to the fixing portions, the fixing portions being formed at both side ends of the transfer area of the transfer holder, and the transfer unit is inserted into a space between the pre-transfer guide and the post-transfer guide.

3. The transfer apparatus according to claim 1, further including means for preventing crimping.

4. The transfer apparatus according to claim 3, wherein the means for preventing crimping are on the pre-transfer guide and the post-transfer guide.

5. The transfer apparatus according to claim 4, wherein the means for preventing crimping include pointed elements.

6. The transfer apparatus according to claim 3, wherein the means for preventing crimping include pointed elements.

7. The transfer apparatus according to claim 1, further including shield members for supporting the pre-transfer guide.

8. A transfer apparatus comprising a transfer unit for transferring an image formed on a transfer medium onto a conveyed transfer material, comprising:

a pre-transfer guide for guiding the transfer material into a transfer area between the transfer medium and the transfer unit; and a post-transfer guide integrated with the pre-transfer guide to constitute a transfer holder, for guiding the transfer material out of the transfer area between the transfer medium and the transfer unit, wherein the transfer holder is attached to the transfer unit, and the transfer unit includes a plurality of shield members, a pre-transfer roller supported between the transfer area and the pre-transfer guide, on supporting portions provided on at least one of the shield members, and, a wire for performing corona discharge.

9. The transfer apparatus of claim 1 or 8, wherein a positioning member for positioning the transfer holder is provided outside the transfer area of the transfer unit, and the positioning member is used to position the transfer holder.

10. The transfer apparatus of claim 9, wherein the positioning rib is placed on the pre-transfer guide.

11. The transfer apparatus of claim 8, wherein the transfer holder has fixing portions which connect the pre-transfer guide and the post-transfer guide so that they are integrated into one piece the fixing portions being formed at both side ends of the transfer area of the transfer holder, and positioning ribs formed on the fixing portions.

12. The transfer apparatus according to claim 8, wherein ends of the shield members are bent to form bent portions and the bent portions are adjacent to each other and form a groove.

13. The transfer apparatus of claim 12, wherein a portion of the pre-transfer guide is placed in the groove.

14. A transfer apparatus comprising:

a transfer unit for transferring an image formed on a transfer medium onto a conveyed transfer material, a pre-transfer guide for guiding the transfer material into a transfer area between the transfer medium and the transfer unit; and a post-transfer guide for guiding the transfer material out of the transfer area between the transfer medium and the transfer unit, the pre-transfer guide and the post-transfer guide are a single monolithic piece to constitute a transfer holder, the transfer holder being formed solely of insulating material, wherein the transfer unit includes a wire for performing corona discharge and the transfer unit is attached to the transfer holder.

* * * * *